US007621350B2

(12) United States Patent
Richert

(10) Patent No.: US 7,621,350 B2
(45) Date of Patent: Nov. 24, 2009

(54) IMPREGNATED BIT WITH CHANGEABLE HYDRAULIC NOZZLES

(75) Inventor: Volker Richert, Lower Sachsony (DE)

(73) Assignee: Baker Hughes Incorporated, Houston, TX (US)

( * ) Notice: Subject to any disclaimer, the term of this patent is extended or adjusted under 35 U.S.C. 154(b) by 98 days.

(21) Appl. No.: 11/952,308

(22) Filed: Dec. 7, 2007

(65) Prior Publication Data

US 2008/0135307 A1 Jun. 12, 2008

Related U.S. Application Data

(60) Provisional application No. 60/874,121, filed on Dec. 11, 2006.

(51) Int. Cl.
*E21B 21/00* (2006.01)
*E21B 10/36* (2006.01)

(52) U.S. Cl. ..... 175/393; 175/420.2

(58) Field of Classification Search ..... 175/393, 175/348, 340, 394, 171, 434, 428, 379, 39, 175/426, 400, 425, 405, 1, 414, 420.2
See application file for complete search history.

(56) References Cited

U.S. PATENT DOCUMENTS 3,215,215 A * 11/1965 Kellner ..... 175/405.1
4,293,048 A * 10/1981 Kloesel, Jr. ..... 175/340
5,699,868 A * 12/1997 Caraway et al. ..... 175/339
6,510,906 B1 1/2003 Richert et al.
6,843,333 B2 1/2005 Richert et al.

OTHER PUBLICATIONS

Hughes Christensen "Expanding the World of Impreg Applications", 4 pages.
Baker Hughes—Hughes Christensen "Diamond Bits—Impregnated Bits", 2 pages.

* cited by examiner

*Primary Examiner*—Jennifer H Gay
*Assistant Examiner*—Yong-Suk Ro
(74) *Attorney, Agent, or Firm*—Bracewell & Giuliani LLP

(57) ABSTRACT

A diamond impregnated bit crown has blades formed thereon. Flow channels are formed between the blades, the flow channels having inner and outer ends and extending outward to a gage surface of the crown. At least some of the flow channels have an enlarged width area that has a greater width than a portion of the channel immediately outward from the enlarged width area. A nozzle is releasably secured in each of the enlarged width areas for discharging drilling fluid.

7 Claims, 2 Drawing Sheets

IMPREGNATED BIT WITH CHANGEABLE HYDRAULIC NOZZLES

CROSS-REFERENCE TO RELATED APPLICATION

This application claims priority to U.S. provisional application 60/874,121, filed Dec. 11, 2006.

FIELD OF THE INVENTION

This invention relates to earth boring bits and in particular to a drag bit having a diamond impregnated crown having replaceable nozzles for drilling fluid flow.

BACKGROUND OF THE INVENTION

One type of earth boring bit, called "impregnated bit" is used for drilling relatively hard, abrasive, or hard and abrasive rock formations, such as sandstones. An impregnated bit has a crown or cutting face composed of diamond impregnated matrix. The matrix may comprise super abrasive cutting particles, such as natural or synthetic diamond grit, dispersed within a matrix of wear resistant material. The wear resistant matrix typically comprises a tungsten carbide powder infiltrated with a copper-based binder.

The crown is molded to define blades having a variety of shapes. Flow channels, also called "junk slots", are located between the blades. Ports are located in some of the channels. Each port extends through the shell of the crown to an interior cavity for discharging drilling fluid pumped down the drill string.

The ports are fixed in diameter and they tend to wear or wash out during use. Using replaceable nozzles is known for some types of earth boring bits, particularly rolling cone bits. However, the widths of the flow channels are not sufficient for these types of nozzles.

SUMMARY

The bit of this invention has a crown mounted on a body. The crown is formed of a carbide matrix material and has a plurality of impregnated blades formed thereon, at least portions of the blades being separated from each other, defining channels. At least some of the channels has a nozzle port formed therein. A nozzle is releasably fastened to each of the nozzle ports. Each of the nozzles is in fluid communication with a cavity in the body for discharging drilling fluid.

Preferably, each of the nozzle ports is located within an enlarged portion of one of the channels. Each of the enlarged width portions joins a tapered width portion on it outer side. The inner portion of the tapered width portion is smaller in width than the maximum width of the enlarged portion, and it diverges outward to the gage area.

Preferably at least some of the channels have a fixed port, which does not have a replaceable nozzle but leads from the cavity for discharging drilling fluid. Each of the fixed ports is smaller in diameter than any of the nozzle ports. In the preferred embodiment, the nozzle ports are evenly spaced apart from each other and spaced the same distance from an axis of the crown.

DETAILED DESCRIPTION OF THE INVENTION

Figure 1:
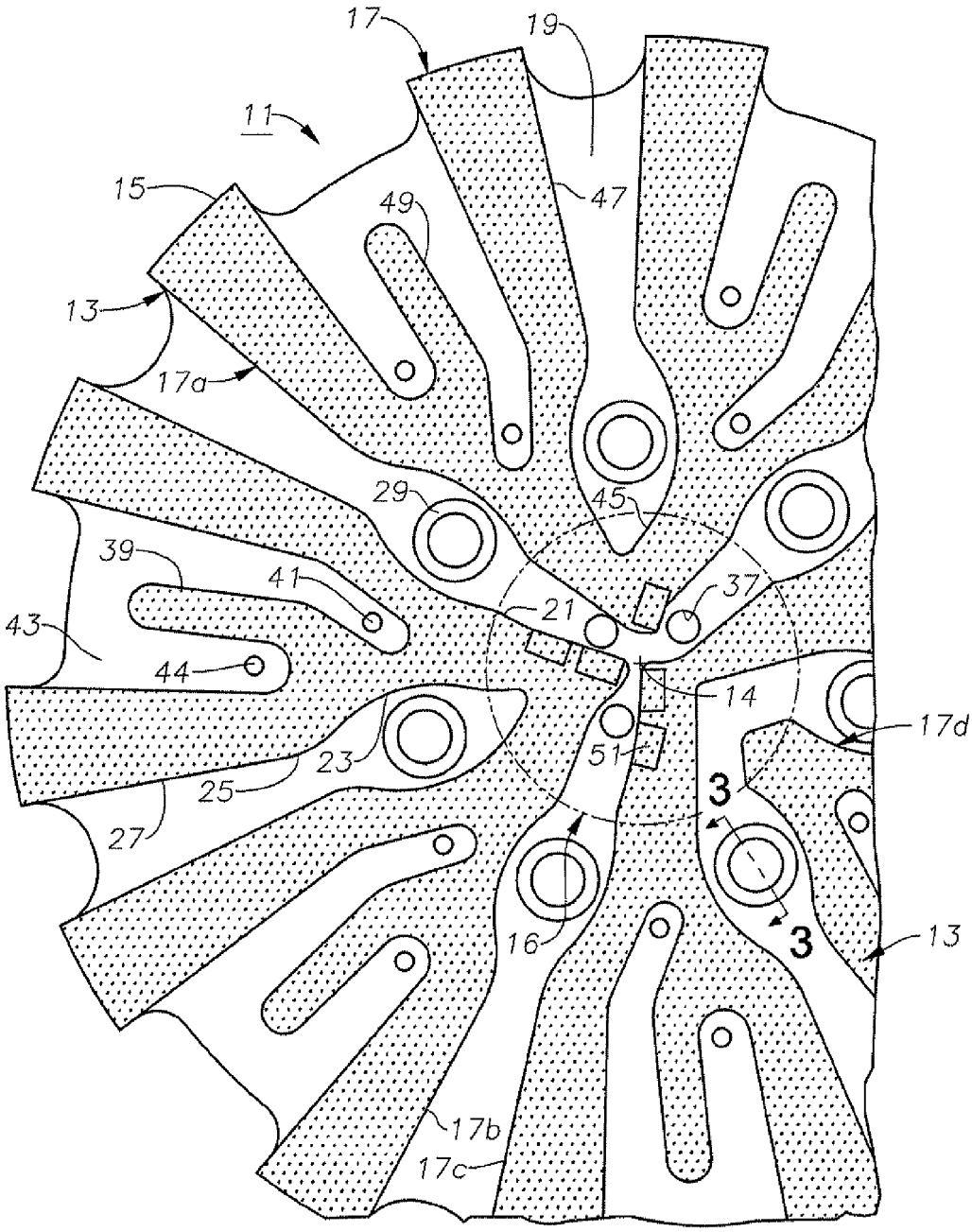
FIG. 1 is a plan view of the bit face of a drag bit constructed in accordance with the invention.

Referring to FIG. 1, a crown 11 of a drag bit is illustrated. Crown 11 is a casting formed of a matrix containing hard metal particles, such as tungsten carbide. Crown 11 has a bit face 13, which is the portion that will engage the bottom of the wellbore. Crown 11 is rotated about its central axis 14 during drilling. Crown 11 has a generally cylindrical gage area 15 surrounding bit face 13 for engaging the sidewall of the wellbore. Normally, crown 11 will have a central region 16 or throat in the center of bit face 13. Central region 16 extends upward into crown 11 from bit face 13 a short distance and has a closed or partially closed base. Central region 16 may have various configurations, such as an inverted cone.

A blade pattern 17 made up of a plurality of blades is formed on bit face 13. Blade pattern 17 is integrally formed as a part of crown 11 during the casting process and contains diamond or other super abrasive particles mixed in with the carbide particles. The relatively fine tungsten carbide material is intended to wear away from the diamond particles interspersed therein, exposing unworn diamonds therein. In this embodiment, the exterior surface of blade pattern 17 is a smooth abrasive surface. Blade pattern 17 may be formed by known processes, such as a pressure infiltration process.

Blade pattern 17 defines a plurality of channels or junk slots that are located between and recessed from the various blades. In the example shown, the channels include a plurality of long channels 19, which extend axially along gage area 15 and generally radially across bit face 13 into central region 16. In this example, seven long channels 19 are shown, but the number could differ. Three of the six long channels 19 extend completely to axis 14, while the other four terminate short of axis 14, but within central region 16. Three of the long channels 19 intersect each other at axis 14. Two of the long channels 19 (shown on the lower right side of the drawing) intersect each other within central region 16, but radially outward from axis 14. The last two long channels 19 do not intersect each other, but terminate within central region 14 radially outward from axis 14.

In this example, each of the seven long channels 19 has a central region portion 21 that forms its radially innermost portion and is located within central region 16. Each long channel 19 has an enlarged width portion 23 joining its central region portion 21 and located a short distance outward from central region 16. Enlarged width portion 23 has a generally circular or rounded contour. In the preferred embodiment, enlarged width portion 23 leads to a reduced width portion 25. A diverging width portion 27 extends radially outward from reduced width portion 25 to gage area 15. The width increases in an outward direction in the diverging width portion 27 to a width somewhat larger than the width of enlarged width portion 23.

A replaceable nozzle 29 is mounted to bit crown 11 within the enlarged width portion 23 of each long channel 19. All of nozzles 29 are located the same radial distance from bit axis 14 in this embodiment. Nozzles 29 are uniformly spaced apart from each other the same circumferential distance in this embodiment. Each nozzle 29 is a short tubular member made of hard, wear resistant material, such as tungsten carbide.

Figure 3:
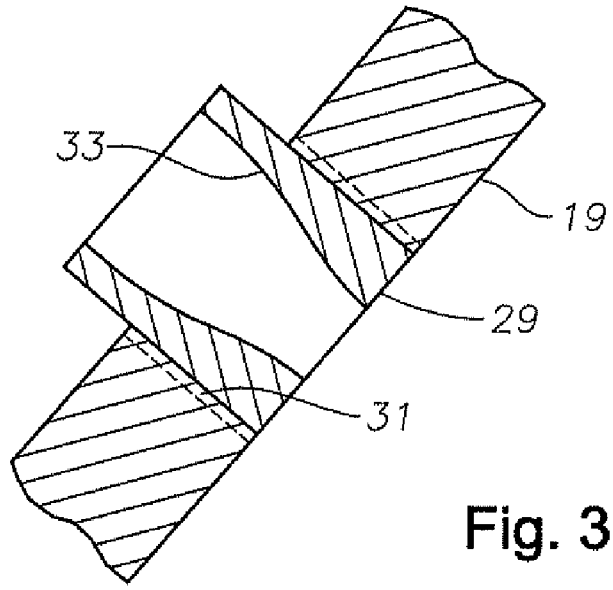
FIG. 3 is an enlarged sectional view of one of the nozzles of the drag bit of FIG. 1, taken along the line 3-3 of FIG. 1.

As shown in FIG. 3, each nozzle 29 has a passage 33 extending through it that is in communication with the interior of crown 11 for discharging drilling fluid pumped down the drill string. Passage 33 may have various configurations, and is illustrated as having a converging downstream portion. Nozzles 29 are oriented to spray drilling fluid generally downward for cooling crown 11 and forcing cuttings radially outward along long channels 19. The downstream end of each nozzle 29 is preferably flush or slightly recessed within the exterior surface of one of the long channels 19. A fastening means allows each nozzle 29 to be readily removed and replaced. In this example, the fastening means comprises mating threads 31 formed on the outer diameter of nozzle 29 and in the hole or port within crown 11 that receives nozzle 29. The downstream end of each nozzle 29 has slots (not shown) formed in it for receiving a tool to tighten or loosen threads 31 of nozzle 29. Alternately, snap rings or threaded retaining rings could be utilized.

In this embodiment, a plurality of central ports 37 are located within central region 16 near axis 14. Three central ports 37 are shown, one in each central region portion 21 of one of the long channels 19. Central ports 37 also discharge drilling fluid pumped down the drill string, however are smaller in diameter than passages 33 of nozzles 29 and do not have replaceable nozzles.

The channels formed by blade pattern 17 also include a plurality of intermediate length channels 39, which extend from gage area 15 partially across bit face 13. The inner end of each intermediate length channel 39 is approximately the same radial distance from axis 14 as each long channel enlarged width portion 23. Each intermediate length channel 39 is located between two of the long channels 19, extends generally radially, and has a dog-leg portion near its inner end. An intermediate port 41 is formed in crown 11 at the inner end of each intermediate channel 39. In this example, there are seven intermediate ports 41, and each is located the same radial distance from axis 14. Intermediate ports 41 also discharge drilling fluid pumped down the drill string, however are smaller in diameter than central ports 37 and do not have replaceable nozzles.

The channels formed by blade pattern 17 also include a plurality of short length channels 43 that extend from gage area 15 partially across bit face 13. The inner end of each short length channel 43 is a longer radial distance from axis 14 than the inner end of each intermediate channel 39. Each short length channel 39 is located between two of the long channels 19 and extends generally radially parallel to the outer portion of one of the intermediate channels 39. An outer port 44 is formed in crown 11 at the inner end of each short channel 43 farther outward from axis 14 than intermediate ports 41. In this example, there are seven outer ports 44, and each is located the same radial distance from axis 14. Outer ports 44 also discharge drilling fluid pumped down the drill string, however are smaller in diameter than central ports 37 and do not have replaceable nozzles.

The pattern of the various channels 19, 39 and 43 results in blade pattern 17 having a plurality of trunks 45 within central region 16 and extending generally radially outward. Six of the trunks 45 intersect another trunk 45. Each trunk 45 divides into two long branches 47 that spread apart from each other, similar to branches of a tree. Each long branch 47 extends generally radially outward from one of the trunks 45 to gage area 15. A short branch 49 joins one of the long branches 47 and extends generally radially outward, but terminates short of gage area 15. Blade pattern 17 may be divided into three generally fan-shaped patterns 17*a*, 17*b* and 17*c*, with fan-shaped patterns 17*a* and 17*b* being identical and defined by two intersecting trunks 45, four long branches 47 and two short branches 49. The third fan-shaped blade pattern 17*c* in this example spreads over a greater angle than the other two blade patterns 17*a*, 17*b*. It, too, has two intersecting trunks 45, four long branches 47 and two short branches 49. However, it has a smaller fan-shaped inset 17*d* that is not fully shown but has a single trunk 45 extending partially into central region 16. Two long branches 47 extend from the trunk 45 of inset 17*d*.

Each long channel 19 starts between two of the trunks 45 and is located between two of the long branches 47. Each intermediate channel 39 is located between one of the long branches 47 and one of the short branches 49. Each short channel 43 is located between one of the long branches 47 and one of the short branches 49.

Central region 16 may have cutting elements within. In this embodiment, a plurality of polycrystalline diamond (PDC) cutting elements 51 are mounted to trunks 45. PDC elements 51 have flat faces oriented into the direction of rotation for scraping the earth formation. Other than within central region 16, bit face 13 does not have any PDC cutting elements.

Figure 2:
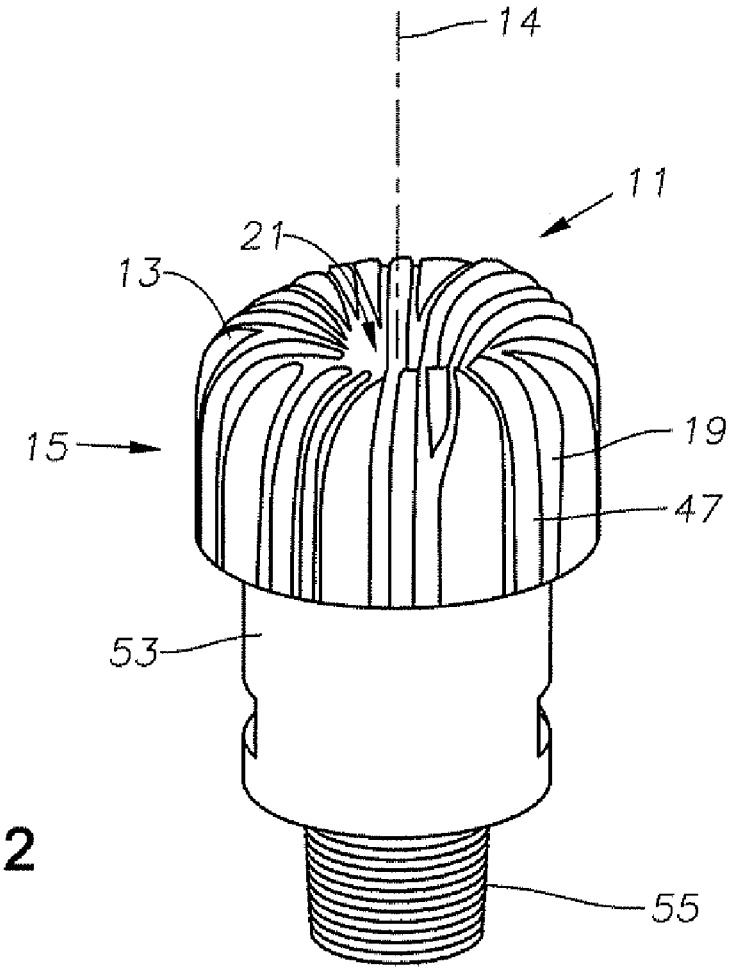
FIG. 2 is a perspective view of the drag bit of FIG. 1.

Referring to FIG. 2, crown 11 is mounted conventionally to a body 53 that is typically formed of steel. Body 53 is a tubular member having a set of threads 55 for connection to a string of drill pipe.

In operation, body 53 is secured by threads 55 to a drill string and lowered into a wellbore. The operator rotates body 53 and pumps drilling fluid down the drill string. Bit face 13 engages and abrades the bottom of the wellbore. Drilling fluid exits the various nozzles 29 and ports 37, 41 and 44. The fluid flows out the various channels 19, 39 and 43 and returns up the annulus of the borehole surrounding the drill string.

After drilling a particular section of a well, the bit may be retrieved for various reasons. Blade pattern 17 may still have a useful life. However, the drilling fluid tends to erode and wear away nozzles 29. If damaged too severely, the operator can unscrew one or more of the nozzles 29 and replace them with new ones. The operator may re-use the bit in the same wellbore or another.

While the invention has been shown in only one of its forms, it should be apparent to those skilled in the art that it is not so limited but is susceptible to various changes without departing from the scope of the invention.

The invention claimed is:

1. An earth boring bit, comprising:

a diamond impregnated crown having an axis of rotation, a gage area, and a plurality of blades formed thereon;

a first set of channels formed between some of the blades and extending outward to the gage area, each channel of the first set of channels having an enlarged width area joining a diverging width area that increases in width to the gage, the junction between the enlarged width area and the diverging width being smaller in width than a maximum width of the enlarged width area;

a nozzle port formed in each of the enlarged width areas;

a nozzle releasably fastened to each of the nozzle ports;

a second set of channels formed between some of the blades and extending outward to the gage area; and a fixed port located in each channel of the second set of channels, each of the fixed ports being of smaller diameter than each of the nozzle ports and not having any of the nozzles therein.

2. The bit according to claim 1, wherein at least some of the fixed ports are located closer to the axis than any of the nozzle ports.

3. The bit according to claim 1, wherein at least some of the fixed ports are located farther from the axis than any of the nozzle ports.

4. The bit according to claim 1, wherein at least some of the channels of the first set of channels have a fixed port therein that is closer to the axis than the nozzle ports.

5. The bit according to claim 1, wherein at least some of the first channels extend continuously from the axis to the gage area.

6. The bit according to claim 1, wherein at least some of the blades are have inner portions that join other of the blades.

7. The bit according to claim 1, wherein each of the nozzles has an upstream end recessed within a central cavity of the crown and a downstream end substantially flush with an exterior surface of the crown.

* * * * *